US011365359B2

(12) United States Patent
Abhari et al.

(10) Patent No.: US 11,365,359 B2
(45) Date of Patent: Jun. 21, 2022

(54) RENEWABLE HYDROCARBON LIGHTER FLUID

(71) Applicant: REG SYNTHETIC FUELS, LLC, Ames, IA (US)

(72) Inventors: Ramin Abhari, Bixby, OK (US); H. Lynn Tomlinson, Leonard, OK (US); Nate Green, Ames, IA (US)

(73) Assignee: REG Synthetic Fuels, LLC, Ames, IA (US)

( * ) Notice: Subject to any disclaimer, the term of this patent is extended or adjusted under 35 U.S.C. 154(b) by 0 days.

(21) Appl. No.: 17/023,605

(22) Filed: Sep. 17, 2020

(65) Prior Publication Data

US 2021/0087480 A1 Mar. 25, 2021

Related U.S. Application Data

(60) Provisional application No. 62/903,388, filed on Sep. 20, 2019.

(51) Int. Cl.
*C10G 65/12* (2006.01)
*C10L 11/04* (2006.01)

(52) U.S. Cl.
CPC ..... *C10G 65/12* (2013.01); *C10L 11/04* (2013.01); *C10G 2300/1003* (2013.01); *C10G 2300/1014* (2013.01); *C10G 2300/1018* (2013.01); *C10G 2300/202* (2013.01); *C10G 2300/207* (2013.01); *C10G 2300/304* (2013.01); *C10G 2300/308* (2013.01); *C10L 2200/0484* (2013.01); *C10L 2230/06* (2013.01); *C10L 2270/08* (2013.01)

(58) Field of Classification Search
CPC ..... Y02E 50/14; Y02E 50/13
USPC ..... 585/240–242
See application file for complete search history.

(56) References Cited

U.S. PATENT DOCUMENTS

| | | | | |
|---|---|---|---|---|
| 8,581,013 | B2 * | 11/2013 | Abhari | C10L 1/06 585/14 |
| 8,722,591 | B2 | 5/2014 | Marlin | |
| 8,728,178 | B2 | 5/2014 | Moe et al. | |
| 9,061,951 | B2 * | 6/2015 | Abhari | C07C 9/14 |
| 9,084,507 | B2 | 7/2015 | Moe et al. | |
| 9,187,385 | B1 | 11/2015 | Parrott | |
| 9,404,064 | B2 | 8/2016 | Guay et al. | |
| 10,246,658 | B2 * | 4/2019 | Abhari | C10L 1/08 |
| 11,001,774 | B2 * | 5/2021 | Abhari | C10G 3/50 |
| 2005/0115145 | A1 * | 6/2005 | Decker | C10L 1/1824 44/385 |
| 2005/0120618 | A1 * | 6/2005 | Stephanos | C10L 11/04 44/266 |
| 2011/0008507 | A1 * | 1/2011 | Moe | C10L 1/026 426/523 |
| 2011/0269654 | A1 * | 11/2011 | Marlin | C10L 1/02 508/216 |
| 2015/0083643 | A1 * | 3/2015 | Dindi | C10G 47/06 208/89 |
| 2016/0257899 | A1 * | 9/2016 | Parrott | C10L 9/10 |
| 2018/0291296 | A1 * | 10/2018 | Adolphson | C10L 5/26 |

* cited by examiner

*Primary Examiner* — Nina Bhat
(74) *Attorney, Agent, or Firm* — Foley & Lardner LLP

(57) ABSTRACT

The present technology relates to hydrocarbon fluids, and more particularly, a hydrocarbon lighter fluid derived from renewable sources. Specifically, renewable fatty acids/glycerides are converted to a charcoal lighter fluid with the same or better performance than a petroleum middle distillate derived charcoal lighter fluid.

7 Claims, 2 Drawing Sheets

RENEWABLE HYDROCARBON LIGHTER FLUID

CROSS-REFERENCE TO RELATED APPLICATION

This application claims the benefit of and priority to U.S. Patent Application No. 62/903,388, filed on Sep. 20, 2019, the contents of which are incorporated herein by reference in their entirety.

FIELD OF THE INVENTION

The present technology relates to hydrocarbon fluids, and more particularly, a hydrocarbon lighter fluid derived from renewable sources. Specifically, the present invention relates to converting fatty acids/glycerides to a charcoal lighter fluid with the same or better performance as petroleum middle distillates.

BACKGROUND OF THE INVENTION

Cooking food on charcoal grills is a popular pastime in many cultures around the world. The charcoal may be in briquette or lump form, and is typically lit using a lighter fluid. The most common lighter fluids are petroleum distillates. Depending on source of crude oil and refining process, petroleum distillates contain varying concentrations of aromatic hydrocarbons and sulfur species. These aromatic and sulfur species may in turn affect the quality and safety of the grilled food.

Additionally, petroleum distillates are a source of greenhouse gas emissions. Based on methodology adopted by the California Air Resources Board, petroleum distillates have a life cycle greenhouse gas emission of greater than 100 g $CO_2$ equivalent per mega Joules of combustion energy provided ($gCO_2e/MJ$). This value is also referred to as Carbon Intensity or C.I.

Lower carbon intensity charcoal lighter fluid products that are free of aromatic hydrocarbons have been disclosed. U.S. Pat. No. 8,722,591 to Joseph Marlin describes a charcoal lighter fluid that is a mixture of 50-70% ethanol and 30-50% biodiesel (methyl-, ethyl-, and propyl-esters of fatty acids). Biodiesel is typically produced from vegetable oils and animal fats. According to the disclosure, ethanol acts as an accelerant for ignition of the biodiesel-based fluid.

U.S. Pat. Nos. 8,728,178 and 9,084,507 to Dave E. Moe and Reed E. Oshel describe an improved lighter fluid composition made of n-butanol and biodiesel. According to the disclosure, this lighter fluid has reduced emissions of volatile organic compounds (VOCs) compared to a petroleum-based lighter fluid. Based on comparative test results provided therein, the biodiesel-based lighter fluid provides a different briquette ashing performance than the commercially available petroleum-based Kingsford lighter fluid.

U.S. Pat. No. 9,187,385 to Paul Parrott describes a charcoal ignition fluid that is composed of a blend of bio-based hydrocarbons. According to the patent, the fluid utilizes linear and branched alkanes produce by means of variations of the Fischer-Tropsch process. The process for producing the charcoal ignition fluid deoxygenates fatty acids, esters, etc. by removing and fully saturating all double bonds in the bioactive raw material. The hydrocarbon fluid comprises a broad cut of $C_5$-$C_{24}$ alkanes, with a 144-300° C. boiling range. In an embodiment, the ignition fluid includes more than 20 wt % proprietary compounds, and up to 30 wt % performance additives. In other embodiments, the ignition fluid includes 3-5% bio-butanol and 3-6% bio-pentanol.

U.S. Pat. No. 9,187,385, also to Paul Parrott, discloses a charcoal ignition fluid that is composed of a cellulose ether polymer, butanol, and water. The charcoal ignition fluid has performance characteristics similar to petroleum distillate but is more sustainable. Additionally, the charcoal ignition fluid can include ethanol. The charcoal ignition fluid may also include an organic ester to enhance the odor of the ignition fluid, or an acetate salt to increase its visible flame for safety purposes.

Our own U.S. Pat. No. 10,246,658 provides a composition that includes at least about 98 wt % n-paraffins, suitable for use as a transportation fuel/fuel blendstock, a heater fuel, or charcoal lighter fluid. The composition is prepared using a single hydroprocessing step wherein lipid fatty acid chains undergo hydrodeoxygenation to mostly (at least 75 wt %) even carbon number paraffins.

Light alcohols such as ethanol and butanol have a lower energy density than hydrocarbons. For example, butanol has an energy density of 36 MJ/kg compared to 45 MJ/kg for petroleum distillates. There is therefore a need for a low carbon intensity hydrocarbon charcoal lighter fluid that is free of detectable aromatic hydrocarbons (as measured by ASTM D2425), lower in total hydrocarbon emission, lower in sulfur, and performs the same or better than petroleum distillates.

SUMMARY OF THE INVENTION

The present invention relates to a method for producing from a renewable feedstock a hydrocarbon composition useful as a lighter fluid, and also for use as a middle distillate fuel blend stock and solvent. The renewable feedstock includes sources of glycerides (i.e. monoglycerides, diglycerides, triglycerides) and/or fatty acids and combinations thereof, such as animal fats, animal oils, poultry fat, poultry oils, vegetable oils, vegetable fats, plant fats and oils, rendered fats, rendered oils, restaurant grease, used cooking oil, brown grease, waste industrial frying oils, fish oils, tall oil, algal oils, microbial oils, pyrolysis oils, and the like and any combinations thereof.

The method for producing renewable hydrocarbon lighter fluid includes hydrotreating the renewable feedstock to produce a heavy hydrocarbon fraction. This is followed by hydrocracking of the heavy fraction to produce a distribution of hydrocarbon components, typically $C_3$-$C_{18}$, which is fractionated to recover the lighter fluid product. The heavy fraction is optionally recycled to the hydrocracker.

The hydrotreating of triglycerides and fatty acids involves hydrogenation of carbon-carbon double bonds, and deoxygenation via hydrogenolysis of carbon-oxygen bonds or decarboxylation/decarbonylation. Hydrotreating thus converts fatty acids into long chain paraffins as illustrated in Equations 1 and 2 for conversion of oleic acid to n-octadecane and n-heptadecane.

$$HOOC\text{-}C_{17}H_{33}+4H_2 \rightarrow n\text{-}C_{18}H_{38}+2H_2O \quad (1)$$

$$HOOC\text{-}C_{17}H_{33}+H_2 \rightarrow n\text{-}C_{17}H_{36}+CO_2 \quad (2)$$

When the fatty acids are supported on a glycerol backbone, for example as triglycerides or diglycerides, the hydrotreating reactions of Equations 1 and 2 produce propane as well as the long chain, heavy hydrocarbon fraction. Depending on the source of the fatty acid/glyceride, the heavy hydrocarbon fraction is predominantly in the $C_{12}$ to $C_{24}$ range.

The heavy hydrocarbons are subsequently hydrocracked into shorter chain hydrocarbons to produce the renewable hydrocarbon lighter fluid. In the illustrative hydrocracking reactions of Equations 3-6, n-octadecane is hydrocracked into shorter linear and methyl-branched saturated hydrocarbons (denoted as n-paraffin and iso-paraffin respectively), comprising nonanes, decanes, and lighter coproducts including hexanes, pentanes, and propane/butanes.

$$C_{18}H_{38}+H_2 \rightarrow n\text{-}C_9H_{20}+\text{iso-}C_9H_{20} \quad (3)$$

$$C_{18}H_{38}+H_2 \rightarrow n\text{-}C_{10}H_{22}+\text{iso-}C_8H_{18} \quad (4)$$

$$i\text{-}C_9H_{20}+H_2 \rightarrow \text{iso-}C_5H_{12}+\text{iso-}C_4H_{10} \quad (5)$$

$$n\text{-}C_9H_{20}+H_2 \rightarrow \text{iso-}C_6H_{14}+C_3H_8 \quad (6)$$

The hydrocracked hydrocarbons are then fractionated to yield a narrow hydrocarbon cut comprising at least 80 wt % C9 and C10 n-paraffins and iso-paraffins, and having no detectable aromatics as measured by ASTM D2425, Standard Test Method for Hydrocarbon Types in Middle Distillates by Mass Spectrometry. The composition has less than 10 ppm total sulfur and nitrogen. The narrow cut has excellent properties as a charcoal lighter fluid, igniting easily and ashing the charcoal completely. The total hydrocarbon emissions and volatile organic compound (VOC) emissions of the charcoal lighter fluid of the present invention are lower than from petroleum distillates. The carbon intensity of the hydrocarbon lighter fluid of the present technology is around 30 g $CO_2$e/MJ or less as estimated using the CA-GREET3.0 model provided by California Air Resources Board. This C.I. value compares to 50 g $CO_2$e/MJ for ethanol and 100+$CO_2$e/MJ for petroleum distillates as estimated using the same methodology.

DETAILED DESCRIPTION OF THE INVENTION

The present invention relates to a method for producing from a renewable feedstock a hydrocarbon product comprising nonanes and decanes that can be used as a charcoal lighter fluid. The renewable hydrocarbon lighter fluid of the present invention may be used directly as a lighter fluid, as a middle distillate fuel blend stock, light diesel fuel or a solvent.

Figure 1:
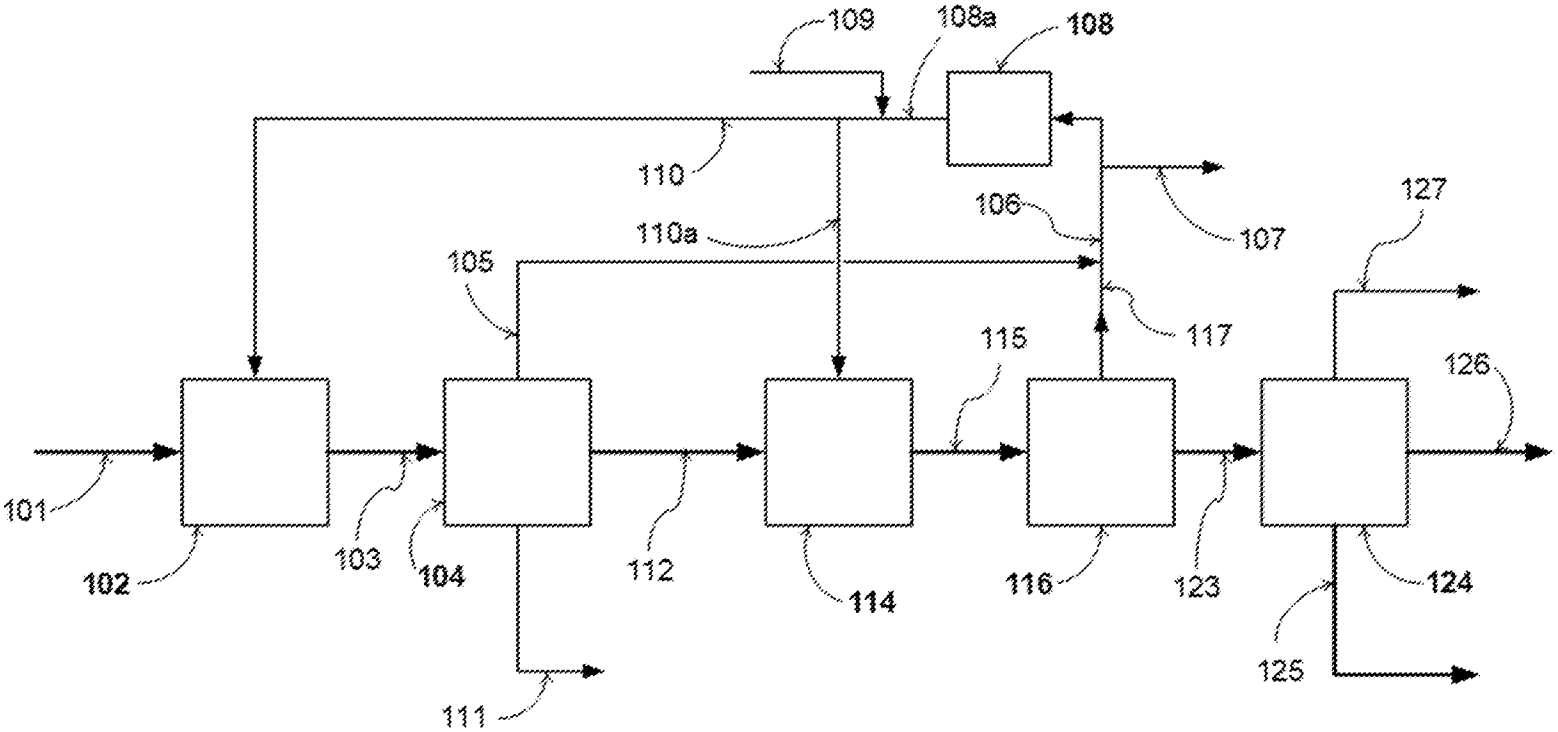
FIG. 1 is a schematic diagram of an operation for producing renewable hydrocarbon lighter fluid according to the present invention.

Referring to the process embodiment of FIG. 1, a renewable feed 101 comprising fatty acid glycerides is transferred to a hydrotreater 102 where it reacts with hydrogen under pressure of from about 300 psig to about 3,000 psig, preferably from about 1,000 psig to about 2,000 psig. Renewable feed 101 may optionally be pretreated to remove phosphorus, silicon, and metal contaminants to less than 10 wppm total. The hydrotreater 102 is preferably a packed bed of sulfided catalyst comprising molybdenum or tungsten. The catalyst is preferably nickel-molybdenum (NiMo), nickel-tungsten (NiW), or cobalt-molybdenum (CoMo) on γ-alumina support. It should be understood by one of ordinary skill in the art that any catalyst may be used in the present invention so long as the catalyst functions in accordance with the present invention as described herein.

To maintain the active metal sulfide functionality of the catalyst despite absence or low concentrations of organic sulfur in most renewable feeds, renewable feed 101 may be supplemented with a sulfur compound that decomposes to hydrogen sulfide when heated and/or contacted with a catalyst. Two preferred sulfur compounds are dimethyl disulfide and carbon disulfide. Preferred concentration of these in the renewable feed 101 is from about 100 to about 2,000 ppm by weight sulfur. Alternatively, renewable feed 101 may include a renewable component and a petroleum fraction wherein the petroleum-fraction provides the sulfur or even a renewable fraction that contains sulfur.

Feed 101 may be preheated before entering the hydrotreater 102. The hydrotreater 102 operates from about 300° F. to about 900° F., preferably from about 550° F. to about 650° F. In order to reduce the adiabatic temperature rise from the exothermic hydrotreating reactions and to maintain the hydrotreater 102 in the preferred operating temperature range, a number of methods known in the art may be used. These methods include, but are not limited to, feed dilution with a solvent or other diluent, liquid product or solvent recycle, and use of quench zones within the fixed-bed reactor wherein hydrogen is introduced.

The renewable feed 101 liquid hourly space velocity through the hydrotreater 102 is from about 0.2 $h^{-1}$ to about 10 $h^{-1}$, preferably from about 0.5 $h^{-1}$ to about 5.0 $h^{-1}$. The ratio of hydrogen-rich treat gas 110 to renewable feed 101 is in the about 2,000 to about 15,000 SCF/bbl range, preferably between 4,000 and 12,000 SCF/bbl. The hydrogen-rich treat gas 110 may contain from about 70 mol % to about 100 mol % hydrogen.

A hydrotreater effluent 103 includes a deoxygenated heavy hydrotreater fraction and a vapor fraction comprising unreacted hydrogen. The heavy hydrocarbon fraction comprising paraffins in the $C_{12}$-$C_{24}$ range with up to 3% compounds heavier than $C_{24}$. The hydrogen-rich vapors include $C_1$-$C_3$ hydrocarbons, water, carbon oxides, ammonia, and hydrogen sulfide, in addition to hydrogen. The long chain, heavy hydrocarbon fraction in the liquid phase is separated from the vapor phase components in a separation unit 104.

The separation unit 104 comprises a high-pressure drum operated at hydrotreater discharge pressure (about 1,000 psig to about 2,000 psig in the preferred embodiment), wherein the heavy hydrocarbon fraction is separated from hydrogen and gas phase hydrotreater byproducts. It should be understood that the hydrotreater discharge pressure may be from about 200 psig to about 3,000 psig. Depending on temperature, the water byproduct may be in vapor or liquid phase. In embodiments, the high-pressure drum operates at a temperature range of about 350° F. to about 500° F. whereby water, carbon oxides, ammonia, hydrogen sulfide, and propane are separated along with hydrogen from the heavy hydrocarbon liquid in a vapor phase. In a preferred embodiment, the separation unit 104 further comprises a high-pressure drum operating at a lower temperature, typically from about 60° F. to about 250° F. for condensing an aqueous stream 111. The condensed aqueous phase 111, comprising dissolved ammonia, sulfur species and carbon dioxide, is thus separated from the hydrogen-rich gas phase 105 that is subsequently recycled to the hydrotreater 102.

A heavy hydrocarbon product stream 112 from the separation unit 104 is then cracked in a hydrocracker 114. Product stream 112 is optionally combined with unconverted heavies from the hydrocracker 114, recycled stream 125, to form a hydrocracker feed comprising unconverted heavies.

The heavy hydrocarbon feed 113 cracks in the hydrocracker 114 to form lighter hydrocarbons comprising nonanes and decanes. The hydrocracker 114 operates under about 250 psig to about 3,000 psig, preferably from about 800 psig to about 2,000 psig, hydrogen pressure provided by a hydrogen-rich gas 110*a*. Hydrocracker 114 temperatures are from about 400° F. to about 900° F., preferably from about 580° F. to about 750° F. Suitable catalysts for hydrocracking according to the present invention as described herein are bi-functional catalysts with hydrogenation and acid functionalities. Such catalysts include Periodic Table Group 6 and Groups 8-10 metals on amorphous or crystalline (e.g. zeolite) supports comprising silica and alumina. Preferred hydrocracking catalysts are noble metals platinum, palladium or combinations thereof on crystalline silica-alumina supports comprising zeolites. However, it should be understood that any catalyst may be used in accordance with the present invention as long as it functions as described herein. Preferred ratios of the hydrogen-rich gas 110*a* to heavy hydrocarbon feed 113 for hydrocracking are in the about 1,000 to about 5,000 SCF/bbl range, with liquid hourly space velocity of about 0.1 $h^{-1}$ to about 8 $h^{-1}$ range, preferably from about 0.2 $h^{-1}$ to about 4 $h^{-1}$. Stream 115 is an effluent of the hydrocracker 114. Stream 115 is a two-phase fluid wherein the gas phase comprises un-reacted hydrogen. A hydrogen-rich gas 117 is separated from the hydrocarbon product in a separation unit 116.

The separation unit 116 includes a high pressure separation drum (not shown), operating at hydrocracker discharge pressure, about 700 psig to about 2,000 psig in the preferred embodiment, wherein hydrocarbon liquids are separated from hydrogen, hydrocarbon vapors, and any other gas phase cracked products.

The hydrogen-rich gas 117 from the separation unit 116 is combined with a hydrogen-rich gas 105 from the separation unit 104 becoming stream 106 and optionally processed through an absorption column or scrubber 108 to remove ammonia, carbon oxides, and/or hydrogen sulfide, before recompression for recycle to the hydrotreater 102 and/or hydrocracker 114. Depending on the contaminant to be removed, the scrubber 108 may use various solvents such as amine and caustic solutions. It is clear to those skilled in the art that other gas cleanup technologies may be used instead of or in addition to the scrubber 108 to remove contaminants that affect the hydrotreater 102 and hydrocracker 114 catalyst activity and selectivity. Examples of alternative gas cleanup technologies include membrane systems and adsorbent beds.

A bleed gas 107 may be removed from a recycle gas 106 to prevent buildup of contaminants that are not effectively removed in the scrubber 108. The cleaned hydrogen-rich gas 108*a* from the scrubber 108 may be combined with makeup hydrogen 109 to form a hydrogen-rich gas stream 110 for the hydrotreater 102 and hydrocracker 114.

Stream 123 is the liquid hydrocarbon phase from the separation unit 116. Stream 123 is processed through fractionator unit 124 to fractionate the hydrocracker products into a light hydrocarbon stream 127, the desired lighter fluid product 126, and a hydrocracker heavies fraction 125 which is optionally recycled to extinction through the hydrocracker 114. In embodiments, the hydrocracker heavies fraction 125 is used as a renewable diesel fuel. In embodiments, the light hydrocarbon stream 127 is processed through a debutanizer tower (not shown) to separate the stream into a $C_3$-$C_4$ LPG and a $C_5$-$C_8$ light naphtha.

The fractionator unit 124 is operated to recover the renewable hydrocarbon lighter fluid 126 comprising $C_9$-$C_{10}$ hydrocarbons. The renewable hydrocarbon lighter fluid comprises at least 80 wt % $C_9$ and $C_{10}$ hydrocarbons, n-nonane, iso-nonanes, n-decane, and iso-decanes. In embodiments, the renewable hydrocarbon lighter fluid is at least 84 wt %, at least 86 wt %, at least 88 wt %, and at least 90 wt % $C_9$ and $C_{10}$ hydrocarbons. In embodiments, the renewable hydrocarbon lighter fluid comprises between 80 wt % and 92 wt % $C_9$ and $C_{10}$ hydrocarbons. In embodiments, the hydrocarbons comprise n-paraffins and iso-paraffins. In embodiments, the iso-paraffins are methyl-branched iso-paraffins (e.g. 2-methyl octane and 3-methyl nonane). In embodiments, the ratio of iso-paraffins to n-paraffins in the renewable hydrocarbon lighter fluid is between about 0.9:1 and about 1.1:1.

The renewable hydrocarbon lighter fluid has a flash point of about 38 C to about 44 C, and has no aromatics as detected by ASTM D2425 test method, and is essentially free of oxygenates (e.g. alcohols and esters). The renewable hydrocarbon lighter fluid has a total sulfur and nitrogen content less than 10 wppm and lower total hydrocarbon emissions than petroleum distillates according to South Coast Air Quality Management District Rule 1174.

Figure 2:
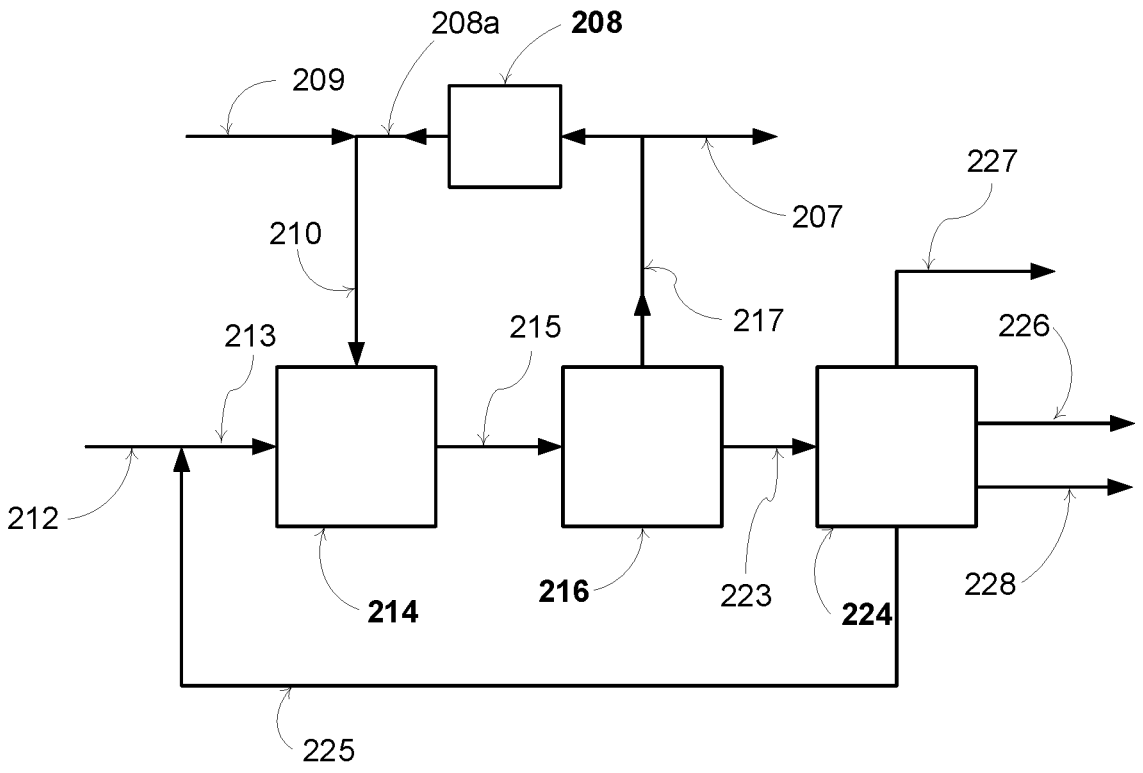
FIG. 2 is a schematic diagram of another embodiment of a method for producing renewable hydrocarbon lighter fluid in accordance with the present invention.

Referring now to FIG. 2, another embodiment of the present invention is illustrated. A renewable feed enters a hydrotreater reactor (not shown). Stream 212 is the heavy hydrocarbon product of the hydrotreating reaction in the hydrotreater. Stream 212 is optionally combined with an unconverted heavy fraction 225 to form a hydrocracker feed 213. Hydrocracker feed 213, a $C_{12}$-$C_{24}$ hydrocarbon distribution with up to 3 wt % compounds heavier than $C_{24}$, is converted to a $C_3$-$C_{18}^+$ hydrocarbon distribution in a hydrocracker 214. An effluent 215 from the hydrocracker 214, is separated into a hydrogen-rich gas stream 217 and a cracked liquids stream 223 in a separation unit 216. Operating conditions are the same as for FIG. 1.

A fraction of the hydrogen-rich gas 217 is purged as bleed gas 207 and the remaining fraction of the hydrogen-rich gas 217 is compressed in compressor 208. The compressed hydrogen-rich gas 208*a* is then combined with a compressed makeup hydrogen 209 to form a recycle hydrogen-rich gas as hydrocracker hydrogen stream 210.

Stream 223, cracked liquids from the separation unit 216, is transferred to a product fractionator unit 224. The illustrative $C_3$-$C_{18+}$ hydrocracked product is fractioned into a $C_3$-$C_8$ light hydrocarbon stream 227, a renewable hydrocarbon lighter fluid product stream 226, a middle distillate stream 228 suitable for use as jet kerosene or light diesel, and a heavies recycle stream 225.

The resultant renewable hydrocarbon lighter fluid has a boiling point range from about 100° C. to about 200° C. and a density at 15° C. of from about 720 to about 740 kg/$m^3$. The lighter fluid product is a narrow cut comprising at least about 80 wt % $C_9$-$C_{10}$ paraffins, preferably at least 82 wt % $C_9$-$C_{10}$ paraffins, that contrary to the teachings of the prior art has superior performance as a charcoal lighter fluid, without need for additives such as accelerants. Specifically, the renewable hydrocarbon lighter fluid provides very good match light performance and 25-minute briquette ash coverage according to California South Coast Air Quality Management District (SCAQMD) Rule 1174 with an average THC emissions of 0.028 lb/start or less, preferably less than 0.027 lb/start or less. The lighter fluid achieves a 90% or higher ash coverage at a dosage level of 80 g/kg or less, preferably at a dosage level of 70 g/kg or less.

The renewable hydrocarbon lighter fluid has a flash point of about 38° C. to about 44° C., a cetane number greater than 60, and a freezing point less than about −40° C. As a middle distillate fuel additive, the renewable lighter fluid provides the benefit of improving low temperature flow properties without negatively impacting other fuel properties; e.g. by decreasing flash point below specification limit of 38° C. for No. 1-D diesel or depressing cetane number for same.

An alternate use of the lighter fluid is as a low strength, selective solvent. The kauri-butanol value, abbreviated Kb, is defined as the volume of solvent required to reach the cloud point of the solution when added to 20 g of a solution of 20 wt % kauri resin in n-butanol. Kauri resin is extracted from the kauri tree, found in New Zealand. ASTM International has developed the standard D 1133-04 for determining Kb value. A Kb value in the below 30, e.g. with Kb values in the 20-30 range, indicates mild solvency or low solvent strength. On the other hand, a solvent with a Kb value of 100 or higher has a very high solvency and not appropriate for use in applications like extraction where a selective solvency is desired.

The renewable hydrocarbon lighter fluid has a Kauri-Butanol number less than 30, preferably less than 28. In embodiments, the renewable hydrocarbon lighter fluid has a Kb value in the 20-28 range. The renewable lighter fluid may be used for selective dissolution of non-polar components without dissolving more polar compounds. Without being bound to theory, the low VOC and total hydrocarbon (THC) emissions of the lighter fluid of the present invention is believed to be in part due to the fluid's low solvent strength as it relates to the interaction between the lighter fluid with the charcoal briquette. Specifically, the amounts of VOC compounds that could migrate from the briquette into the fluid are less because of the low Kb value of the lighter fluid of the present invention.

The renewable hydrocarbon lighter fluid has a sulfur and nitrogen content less than 10 ppm, preferably less than 8 ppm, and most preferably less than 6 ppm. Due to its high energy density and paraffinic composition (i.e. high hydrogen-to-carbon ratio), the renewable hydrocarbon lighter fluid may also be used as a hydrogen source or as a fuel cell fuel. A fuel cell is an electrochemical cell that converts chemical energy of a fuel to electric energy. For example, electric vehicles may be designed to run on renewable hydrocarbon lighter fluid as a safer alternative to hydrogen fuel cell electric vehicles. The low flammability (flash point >38 C) and low sulfur/nitrogen contents, makes this an attractive candidate for this application.

In order to further illustrate the present invention, the following examples are given. However, it is to be understood that the examples are for illustrative purposes only and are not to be construed as limiting the scope of the subject invention.

Example 1

A renewable feedstock comprising used cooking oil was pretreated by a method comprising the steps disclosed in U.S. Pat. No. 9,404,064 to reduce metals, silicon, and phosphorus to less than 10 wppm total. The treated renewable feedstock was then hydrotreated in a fixed-bed reactor system comprising two beds of sulfided catalyst, each catalyst comprising molybdenum. The hydrotreater was operating in the 550-650 F range under about 1800 psig hydrogen pressure. The liquid product was a paraffinic hydrocarbon of mainly $C_{14}$-$C_{18}$ components with less than 2% $C_{24}^{+}$ fraction.

This liquid product was subsequently subjected to hydrocracking in another fixed-bed reactor. The catalyst in this second reactor was a bi-functional catalyst comprising platinum over an acidic crystalline support comprising silica and alumina. The reactor operated at 600-610 F under about 900 psig hydrogen pressure.

The reactor effluent comprising hydrocracked products was then fractionated to recover a lighter fluid stream in the 100-200° C. boiling range. The composition of the lighter fluid product was determined via GC analysis and is summarized in Table 1.

TABLE 1

Composition of the renewable hydrocarbon lighter fluid of Example 1

| Type of hydrocarbon | C8 | C9 | C10 | C11 | C12 | total |
|---|---|---|---|---|---|---|
| n-paraffin | 0.81% | 27.4% | 18.2% | 2.9% | 0.0% | 49.3% |
| Iso-paraffin | 0.19% | 17.3% | 21.8% | 10.5% | 0.83% | 50.6% |

As observed from Table 1, the renewable hydrocarbon lighter fluid has an iso/normal ratio (ratio of iso-paraffins to n-paraffins) of 1.03. The flash point of the hydrocarbon lighter fluid was measured as 43° C.

Example 2

The lighter fluid of the present invention produced according to Example 1 was evaluated against commercial charcoal lighter fluid products. The method chosen for evaluation was the procedure described in California South Coast Air Quality Management District (SCAQMD) Rule 1174, with a modified total hydrocarbon (THC) emission measurement method involving direct measurement off the chimney using a hand-held Thermal Conductivity Detector device. The SCAQMD test is considered the industry standard for charcoal lighter fluid evaluation. It involves addition of 2 lbs of Kingsford brand charcoal briquettes to a fireplace with a damper for control of airflow up to chimney.

The lighter fluid of the present invention was first tested at the recommended dosing level of commercial petroleum-based charcoal lighter fluid (80 g/kg). At this dosing level, the fluid was easily lit and a complete ashing of the charcoal briquettes was achieved during a 25-minute burn cycle. Three replicates of the test were performed. The corresponding ashing and emission results are indicated as Test 1 in Table 2.

TABLE 2

Results of Charcoal Lighter Fluid Performance Tests

| Test No. | Test Fluid | Dosage (g/kg) | Lightability | Ash % | Emissions (lb THC/start) Rep 1 | Rep 2 | Rep 3 | Average |
|---|---|---|---|---|---|---|---|---|
| 1 | Present invention | 80 | very good | 100 | 0.023 | 0.0251 | 0.0269 | 0.0250 |
| 2 | Present invention | 66 | very good | 99 | 0.0255 | 0.027 | 0.0251 | 0.0259 |
| 3 | Kingsford | 80 | very good | 100 | 0.0267 | 0.0264 | 0.0287 | 0.0273 |
| 4 | Smarter Starter | 90 | poor | about 75 | 0.0189 | 0.0136 | 0.0146 | 0.0157 |

Another set of tests was conducted on a different day for the comparative examples of commercially available petroleum-based hydrocarbon and bio-based ester lighter fluid products, "Kingsford" and "Smarter Starter" respectively.

In this set of tests, a substantially lower dosage of the renewable lighter fluid of the present invention was used: 66 g/kg instead of 80 g/kg (mass lighter fluid per mass briquettes). Referring to the results of Table 3 Tests No. 1 and 2, despite the lower dosage, virtually no difference in lightability and ash coverage was observed. ("Lightability" refers to how easily the lighter fluid is ignited with a single match whereas "Ash %" refers to how completely the charcoal briquettes are utilized following the ignition of lighter fluid.)

Using the same lot of charcoal briquettes, a comparative test was run with Kingsford lighter fluid at the recommended dosage (~80 g fluid per kg briquettes), as indicated in the instructions on the Kingsford bottle. Comparing Tests No. 1 and 3, it is observed that at the same dosage levels, the charcoal lighter fluid of the present invention produces lower emissions than the hydrocarbon lighter fluid of the prior art. These lower emissions were achieved at no observed change in performance criteria such as lightability and 25-min ash coverage (ash %).

The instructions provided on the bottle of the bio-based comparative lighter fluid, Smarter Starter, indicated a higher required dosage level. Even at the recommended dosage of 90 g/kg, the lightability was poor. Furthermore, the ash coverages observed after 25 minutes were just over 75% (Table 3 Test No. 4). As such, the lower emission numbers observed may not be directly compared to Test Nos. 1-3 where virtually complete ashing of the briquettes was observed.

Example 3

Hydrocarbons derived from the inventive method (three samples) were analyzed via ASTM D1133 method. The Kb values were 20.5, 23, and 25 indicating low solvent strength.

Example 5

Hydrocarbons derived from the inventive method (four samples) were analyzed for hydrogen and carbon content according to ASTM D5291. The results (mass percent carbon/mass percent hydrogen) were 84.5/15.5, 85.2/14.8, 85.3/14.7, and 84.0/16.0.

Example 4

The renewable hydrocarbon lighter fluid of the present invention produced using a different mix of renewable fats and oils was subjected to broader characterization tests. The results are summarized in Table 3. As observed in Table 3, the energy density (also referred to as heating value) is 46.5 MJ/kg, which is same or higher than petroleum middle distillates (typically in the 45-46 MJ/kg range).

TABLE 3

Attributes of the Renewable Hydrocarbon Lighter Fluid of the Present Invention

| Hydrocarbon Attribute | Test Method | Present Invention |
|---|---|---|
| Acidity, mg KOH/g | ASTM D3242 | 0.001 |
| Distillation temperature, ° C. | ASTM D86 | |
| 10% recovered | | 152.4 |
| 50% recovered | | 159.6 |
| 90% recovered | | 192.2 |
| Residue, vol % | | 1.0 |
| Final boiling point | | 1.0 |
| Flash point, ° C. | ASTM D56 | 40 |
| Density, kg/m$^3$ | ASTM D4052 | 734 |
| Freezing point, ° C. | ASTM D5972 | −42.0 |
| FAME, ppm | IP 585 | <1 |
| Cycloparaffins, mass % | ASTM D2425 | 1.3 |
| Aromatics, mass % | ASTM D2425 | 0.0 |
| Paraffins, mass % | ASTM D2425 | 98.7 |
| Carbon and hydrogen, mass % | ASTM D5291 | 100.0 |
| Nitrogen, mg/kg | ASTM D4629 | 0.5 |
| Water, mg/kg | ASTM D6304 | 15 |
| Sulfur, mg/kg | ASTM D5453 | 4 |
| Heating value, MJ/kg | ASTM D4809 | 46.55 |

What is claimed is:

1. A method for producing a hydrocarbon lighter fluid comprising the steps of (a) hydrotreating a renewable feedstock to produce a heavy hydrocarbon fraction comprising $C_{12}$-$C_{24}$ hydrocarbons;

(b) hydrocracking the heavy hydrocarbon fraction to a $C_3$-$C_{18}^+$ hydrocarbon distribution; and (c) fractionating the $C_3$-$C_{18}^+$ hydrocarbon distribution to recover a hydrocarbon lighter fluid wherein the lighter fluid comprises a ratio of iso-paraffins to n-paraffins of about 0.9:1 to about 1.1:1 and at least 82 wt % $C_9$-$C_{10}$ paraffins, has a cetane number greater than 60, provides an ash coverage of 90% or higher, and has total hydrocarbon emissions of 0.28 lb/start or less according to the South Coast Air Quality Management District Rule 1174 at a dosage level of 80 g/kg or less.

2. The method of claim 1 wherein the renewable feedstock is pretreated to remove phosphorus, silicon, and metal contaminants to less than 10 wppm total.

3. The method of claim 1 wherein the hydrotreating takes place in a reactor comprising a nickel-molybdenum catalyst, at a temperature from about 550 F to about 650 F, under 1,000 to 2,000 psig pressure, and a ratio of hydrogen to renewable feed between 4,000 to 12,000 SCF/bbl.

4. The method of claim 1 wherein the hydrocracking takes place in a reactor comprising a noble metal catalyst on a crystalline support at a temperature from about 580 F to about 750 F, and a ratio of hydrogen to heavy hydrocarbon between 1,000 to 15,000 SCF/bbl.

5. The method of claim 1 wherein the renewable feedstock comprises monoglycerides, diglycerides, triglycerides, free fatty acids, or combinations thereof.

6. The method of claim 5 wherein the renewable feedstock is selected from the group consisting of animal fats, animal oils, poultry fats, poultry oil, vegetable fats, vegetable oils, rendered fats, rendered oils, restaurant grease, brown grease, yellow grease, waste industrial frying oils, fish oils, fish fats, algal oils, microbial oils, and combinations of any two or more thereof.

7. The method of claim 1 wherein the hydrocarbon lighter fluid has a carbon intensity of 30 $gCO_{2e}$/MJ or less according to California Air Resource Board CA-GREET3.0 model.

* * * * *